United States Patent [19]

Westlake et al.

[11] 4,334,803

[45] Jun. 15, 1982

[54] MINE ROOF BOLT

[76] Inventors: Patrick C. Westlake, 415 Vernon Ave., Steubenville, Ohio 43952; Keith Fish, R.D. #1, Box 235, Chester, W. Va. 26034; James D. Mallory, Westwood Dr., Steubenville, Ohio 43952

[21] Appl. No.: 96,837

[22] Filed: Nov. 23, 1979

[51] Int. Cl.[3] ..... E21D 20/00

[52] U.S. Cl. ..... 405/259; 411/396

[58] Field of Search ..... 405/259-262; 85/62, 50 R, 61, 74, 85, 75; 411/396, 397, 382, 360, 337; 10/11 R

[56] References Cited

U.S. PATENT DOCUMENTS

| | | | |
|---|---|---|---|
| 1,067,755 | 7/1913 | Price | 411/360 X |
| 1,346,058 | 7/1920 | Robergel | 411/397 |
| 1,414,979 | 5/1922 | Carter | 85/50 R X |
| 2,237,236 | 4/1941 | Matthews | 411/396 |
| 2,549,332 | 4/1951 | Parker | 411/397 X |
| 3,060,538 | 10/1962 | Simi | 411/337 X |
| 3,181,902 | 5/1965 | Aitken | 85/50 R X |
| 3,298,270 | 1/1967 | Launay | 85/50 R X |
| 3,315,720 | 4/1967 | Gutshall | 85/50 R X |
| 3,854,372 | 12/1974 | Gutshall | 85/61 |
| 3,921,495 | 11/1975 | Braun et al. | 85/50 R X |
| 3,978,758 | 9/1976 | Bright | 411/397 |

FOREIGN PATENT DOCUMENTS

| | | | |
|---|---|---|---|
| 627493 | 10/1927 | France | 411/397 |
| 1119864 | 7/1968 | United Kingdom | 411/397 |

*Primary Examiner*—Dennis L. Taylor
*Attorney, Agent, or Firm*—Paul Bogdon

[57] ABSTRACT

A mine roof bolt of the type used in supporting the ceiling or roofs of underground mine passages is disclosed. The mine bolt includes an elongated shaft, threaded on one end with a stop member in the form of a hemispherical head provided at the other end. A bolt head is force fitted onto the shaft into abutment with the outer stop member. Similarly, a washer is also force fitted onto the shaft and into abutment with the bolt head. An inner stop in the form of an annular bead is formed on the shaft adjacent the underside of the washer.

3 Claims, 2 Drawing Figures

MINE ROOF BOLT

BACKGROUND OF THE INVENTION

This invention relates to a new mine roof bolt of the type used with mine roof bearing plates for supporting the roofs or ceilings of underground mine passages. The roof bolt is secured to an internally threaded, radially expandable anchoring device which is emplaced in a hole drilled in the mine roof. Tightening the roof bolt into the anchor applies tension to the bolt which is transmitted to the bearing plates resulting in a compression force being placed on the strata of the mine roof. A series of the bolt-anchor-bearing plate assemblies are located in the mine passage roof to secure the roof against collapse.

The old style conventional mine roof bolts are formed with an integral bolt head. A washer is required between the bolt head and the roof bearing plate. The washers are separate from the roof bolt and are manually installed prior to attaching the bolt to the anchoring device. The most common method of forming the old-style roof bolts is to pass shafts of steel cut to desired lengths and of desired outer diameter through open ended gas or coal fired furnaces. The shafts are heated to a red-hot temperature and then directed to a hot forge where the integral bolt head is formed. The thus formed roof bolt is then cooled and threads formed on the free end. This process of forming the old-style roof bolts requires very expensive equipment and requires a great amount of heat energy to operate, especially since opened ended furnaces are used.

The required washers for use with the old-style roof bolts are usually shipped to the user in cartons. The mine roof support workers must take the time to install a washer on each bolt. Sometimes washers drop to be lost forever. The washers may be lost by being misplaced in storage or in transport to the mine. Lost washers add unnecessarily to operating costs as does the time it takes to install the washers to the roof bolt.

Another drawback of the old-style roof bolts is that their failures are sudden and catastrophic and cannot be readily anticipated. It is highly desireable to be able to see when a roof bolt is going to fail in order to clear the mine room of people or to prevent collapse of the mine roof by shoring up the roof with added supports.

The present invention overcomes the inherent drawbacks of the old-style roof bolts. The roof bolt of this invention is formed by a cold steel working process which requires relatively inexpensive equipment and very little heat energy. Also, this invention has the required washer permanently installed eliminating the need for on-site assembly and avoiding expensive washer loss. In addition, the roof bolt of this invention will not generally fail in a sudden or catastrophic fashion, but rather will gradually fail where the bolt head and washer will creep, so to speak, off of the bolt shaft. Thus, sight inspection could readily ascertain impending bolt failure, thereby allowing measures to be taken to either shore up the collapsing mine roof or vacating the mine room of all people.

SUMMARY OF THE INVENTION

This invention provides a novel and most useful mine roof bolt which in its preferred form comprises: an elongated bolt shaft having threads formed at least on one end thereof; an outer stop member at the other end of the shaft and formed preferably integrally with the shaft and in the shape of an oversized hemispherical head; a bolt head having an axially extending passageway provided therethrough and sized slightly smaller than the outer dimensions of the bolt shaft, with the bolt head being force fitted onto the shaft and into abutment with the outer stop member; and a washer similarly force fitted onto the shaft and into abutment with the bolt head. Also, in its preferred form, the mine roof bolt of this invention includes an annular bead formed adjacent the underside of the washer to provide an inner stop for the bolt head and washer.

In the form just described, mine roof bolts of this invention are shipped to mine sites ready to be installed with roof bearing plates and anchoring devices. Separate handling of washers is eliminated. More importantly, it has been found that impending failure can be ascertained because the bolt head and washer of the present roof bolt creep along the bolt shaft. Also very importantly from unit roof bolt cost and energy conservation standpoints is the fact that the present roof bolt is formed from essentially a cold working process requiring simple and relatively inexpensive equipment.

Various other advantages, details and modifications of the present invention will become apparent as the following description of a certain present preferred embodiment proceeds.

DESCRIPTION OF THE DRAWINGS

In the accompanying drawings we show a certain present preferred embodiment of our invention in which.

DESCRIPTION OF A PREFERRED EMBODIMENT

Figure 1:
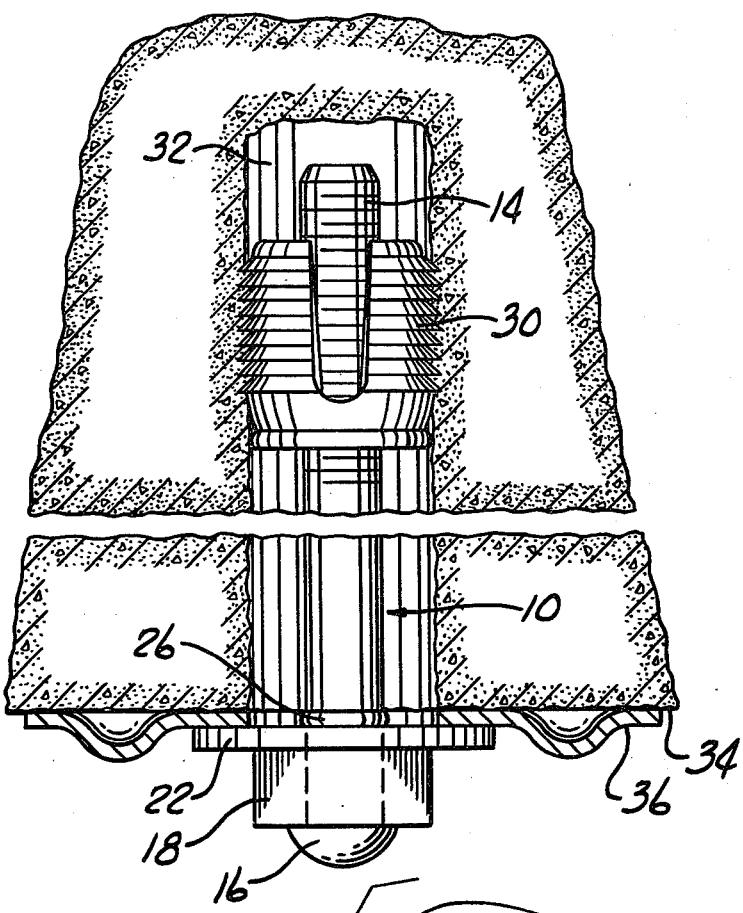
FIG. 1 is an elevation view partly in section showing the mine roof bolt of this invention as it would be assembled with a roof bearing plate and anchoring device in a mine roof.
Figure 2:
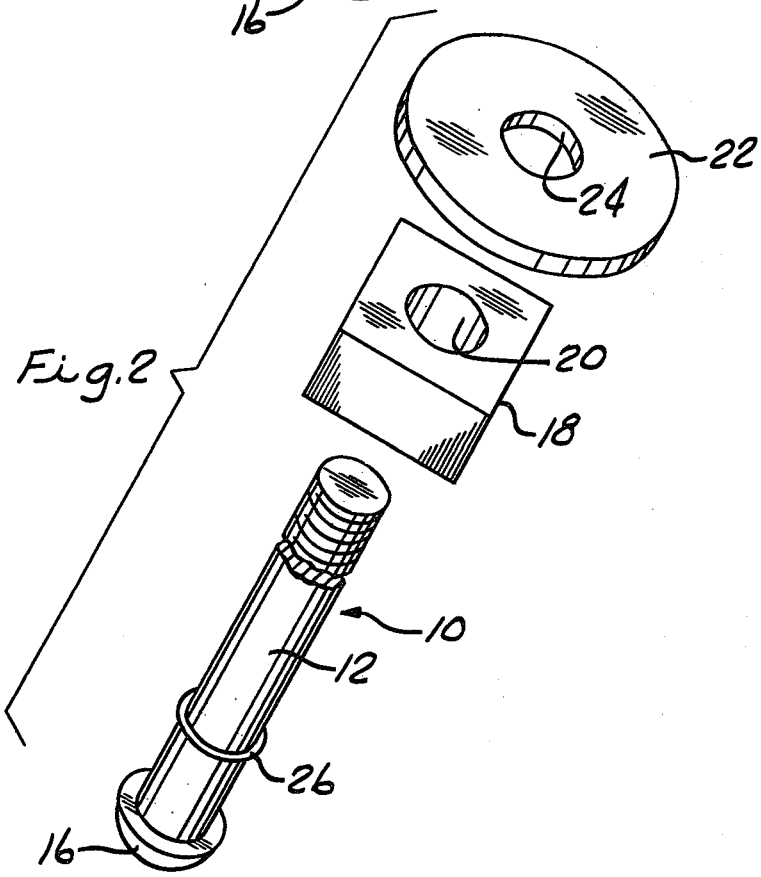
FIG. 2 is a perspective view of the mine roof bolt of this invention showing the bolt head and washer separated from the bolt shaft to show details of construction, it to be understood that the bolt head and washer are fixed to the bolt shaft and not intended to be removable therefrom.

Referring now to the drawings there is shown a mine roof bolt 10 embodying the present invention and illustrating in FIG. 1 a typical mine roof installation. The mine roof bolt 10 includes an elongated generally cylindrically shaped bolt shaft 12 formed of a suitable steel and being typically two feet long and around 9/16 inch in diameter. Suitable threads 14 are formed at one end of the bolt shaft 12. A hemispherically shaped head or outer stop member 16 is formed integrally with the bolt shaft 12 at the other end thereof. A generally square shaped bolt head 18 having an axially extending passageway 20 therethrough is force fitted by any well-known conventional method onto the bolt shaft 12 into abutment with the inner face of the outer stop member 16. The inner diameter of the passageway 20 is slightly smaller than the outer diameter of the bold shaft 12. Typically, each face of the bolt head 18 would be around $\frac{1}{2}$ inch thick and $1\frac{1}{8}$ inch wide. A hardened disc washer 22 typically around $\frac{1}{8}$ inch thick and 1 15/16 inch in outer diameter and provided with an axial opening 24 is also force fitted into the bolt shaft 12 into abutment with the inner face of the bolt head 18. An annualar bead or inner stop member 26 is formed as by swaging on the bolt shaft 12 adjacent to the inner face of the washer 22.

The mine roof bolt 10 is attached to an anchoring device 30 of generally well known construction which is inserted into a suitable hole 32 drilled by conventional means into the strata of the mine roof 34. A mine roof bearing plate 36 of any well known conventional design is disposed to be abutted by the washer 22 on one of its faces and by the mine roof 34 by its other face. A typical installation procedure is to first drill the hole 32, then insert the anchoring device 30 into the hole, then place the bearing plate 36 against the mine roof to align the opening through the plate with the hole 32 and then insert the mine roof bolt 10 through the opening of the bearing plate and into threaded engagement with the anchoring device. At that stage a bolt tightening machine is brought into engagement with the bolt head 18 and the roof bolt is tightened in the anchoring device 30. Thus, the roof bolt 10 is placed under tension which is transmitted to the bearing plate 36 to retain the strata of the mine roof in compression thereby preventing the roof from falling.

It should now be clearly understood how the mine roof bolt of the present invention as just described provides the advantage discussed in the introductory portion of this specification. There is yet another advantage of this invention which was not mentioned. That advantage is related to the installation of the entire support assembly. It happens that at times the threads of the roof bolt cross-thread with the threads of the anchoring device. When that happens with the old-style roof bolt the tightening machine may torque the roof bolt until it fails. Should that happen and the failure is within the mine roof hole, then there is no alternative but to drill a new hole into the roof and make a new support installation. Should cross-threading occur with the roof bolt of the present invention, the tightening machine will cause the bolt head to break free without fracturing the bolt shaft. Such being the case, the bolt shaft may then be manually removed and a new roof bolt installed without any need of drilling a new roof hole.

While we have shown and described a present preferred embodiment of this invention, it is to be distinctly understood that the invention is not limited thereto, but may be otherwise embodied within the scope of the following claims.

We claim:

1. A mine roof bolt comprising an elongated shaft having threads formed at least on one end thereof;

an outer stop member provided at the other end of said shaft and integrally formed with said shaft, said stop member extending laterally outwardly of said shaft;

a bolt head having an axially extending passageway provided therethrough, the inner radial dimensions of said passageway being slightly less than the outer radial dimensions of said shaft, said bolt head being force-fitted onto said shaft in abutment with said outer stop member, the force-fit between said bolt head and said shaft being such that said bolt head will disengage from said shaft and rotate with respect to said shaft when a torque of above a predetermined magnitude is applied to said bolt head;

a generally flat washer member having outer radial dimensions greater than those of said bolt head and provided with an axial opening therethrough of generally the same size as said passageway, said washer member being force-fitted onto said shaft with the outer face thereof in abutment with said bolt head; and said outer stop member, said bolt head, and said washer being constructed and arranged with respect to each other such that when a force exceeding a pre-determined magnitude is applied to said bolt head and said washer in the direction of said outer stop member, said bolt head and said washer will move longitudinally of said shaft and said bolt head will creep over said outer stop member until it becomes free of the outer stop member.

2. A mine roof bolt as set forth in claim 1 including an inner stop member provided adjacent the inner face of said washer member.

3. A mine roof bolt as set forth in claim 2 wherein said inner stop member is in the form of an annular bead formed integrally with said shaft.

* * * * *